US006170228B1

(12) United States Patent
Zeman, III

(10) Patent No.: US 6,170,228 B1
(45) Date of Patent: Jan. 9, 2001

(54) REMOTE CONTROLLED WRAPPING SYSTEM

(76) Inventor: John L. Zeman, III, 1116 Old Pylesville Rd., Pylesville, MD (US) 21132

( * ) Notice: Under 35 U.S.C. 154(b), the term of this patent shall be extended for 0 days.

(21) Appl. No.: 09/406,427

(22) Filed: Sep. 27, 1999

(51) Int. Cl.[7] ..... B65B 11/04
(52) U.S. Cl. ..... 53/74; 53/588; 53/168
(58) Field of Search ..... 53/74, 587, 588, 53/210, 211, 214, 215, 168, 202; 242/557

(56) References Cited

U.S. PATENT DOCUMENTS 4,756,143 * 7/1988 Lancaster ..... 53/588
5,140,795 8/1992 Steding ..... 53/168
5,450,709 9/1995 Steding ..... 53/465

* cited by examiner

*Primary Examiner*—Linda Johnson
(74) *Attorney, Agent, or Firm*—Bartlett & Sherer; Ronald B. Sherer

(57) ABSTRACT

A wrapping apparatus including parallel conveyors for moving loaded pallets to wrapping areas of the conveyors, a mobile wrapping machine on wheels, a guide for maintaining the wrapping machine along a path, position sensors for detecting loaded pallets at loading areas, and a computer control for directing the mobile wrapping machine to wrap the loaded pallets on a prioritized basis. The invention is extremely mobile, and is computer controlled to wrap the pallets without need for an operator.

10 Claims, 3 Drawing Sheets

REMOTE CONTROLLED WRAPPING SYSTEM

FIELD

This invention relates to the wrapping of multiple packages stacked on a pallet, and more particularly, to a total wrapping system in which a mobile wrapping machine is controlled and directed to perform its functions by remote control.

BACKGROUND

The common method of wrapping stacked packages on pallets, such as with stretch plastic film or netting, is by moving the pallet and its load of packages with a fork lift truck to a stationary wrapping machine. The wrapping machine then wraps the load of packages and the wrapped load and pallet is removed from the stationary wrapping machine by a fork lift truck in order to make room for the next loaded pallet to be brought to the wrapping machine. This method is relatively slow, and is quite labor-intensive because many fork lift trucks and truck operators are required in order to supply and remove loaded pallets to and from the wrapping machine in a timely manner in order for the wrapping machine to be operated in any way approaching an efficient manner.

An alternative approach is suggested in U.S. Pat. No. 5,140,795, which is hereby incorporated by reference, in which a wrapping machine is suspended from an overhead beam, and the machine is controlled by hard-wire controls and sliding electrical contacts along the beam so as to move along the elevated beam to multiple wrapping stations as determined by an operator. While this approach is an improvement, the suspension system requires substantial structural requirements, and the sliding contacts may give false signals, and the beam may interfere with other structures such as the overhead conveyors used in some installations.

SUMMARY

The present invention solves all of the above-indicated problems by maintaining the wrapping machine on the ground, but making it extremely mobile and responsive to wireless remote control such as by radio controls, or other wireless controls such as, for example, infra red or laser beams. In addition, the wrapping machine of the present system is completely computer controlled so that the wrapping machine wraps the pallets on a prioritized basis without the need for an operator.

DETAILED DESCRIPTION

Figure 1:
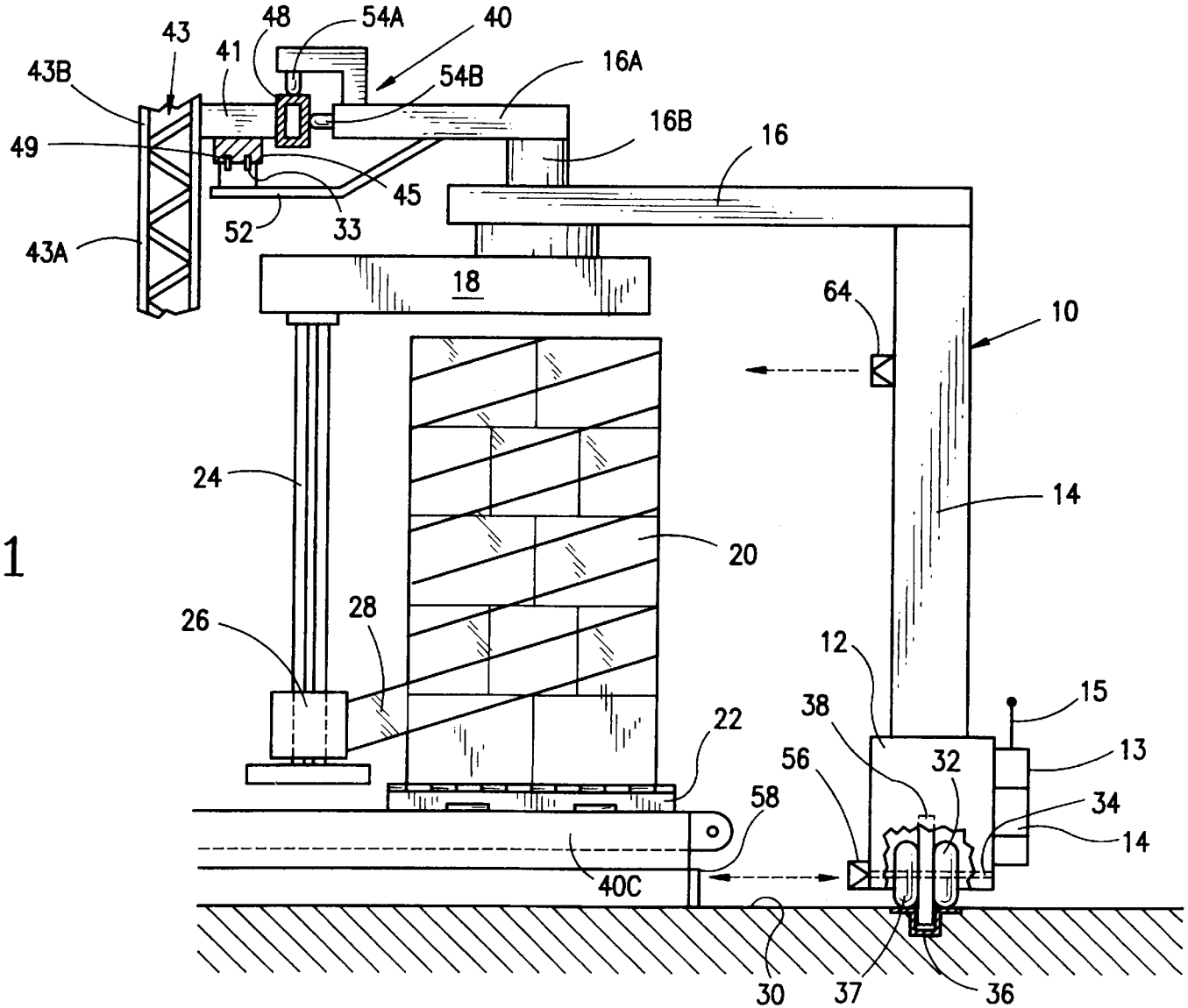
FIG. 1 is a simplified side elevational view, partly in cross-section of a wrapping machine wrapping a load on a pallet which is positioned by a conveyor at a designated wrapping station.

Referring first to FIG. 1, numeral 10 generally designates a wrapping machine which includes a lower or base portion

12, a vertical support stand 14, and a horizontal main frame 16. Frame 16 houses a motor (not shown) which rotates swing arm 18 about load 20 stacked on pallet 22. A depending downright 24 is connected at its upper end to swing arm 18. The lower end of downright 24 carries a film carriage 26. Carriage 26 contains a roll of wrapping material and dispensing mechanism from which a sheet of wrapping material 28, such as stretch plastic film or netting, extends and is wrapped about load 20 as arm 18 rotates in the known manner, per se, of wrapping palletized loads.

Figure 2:
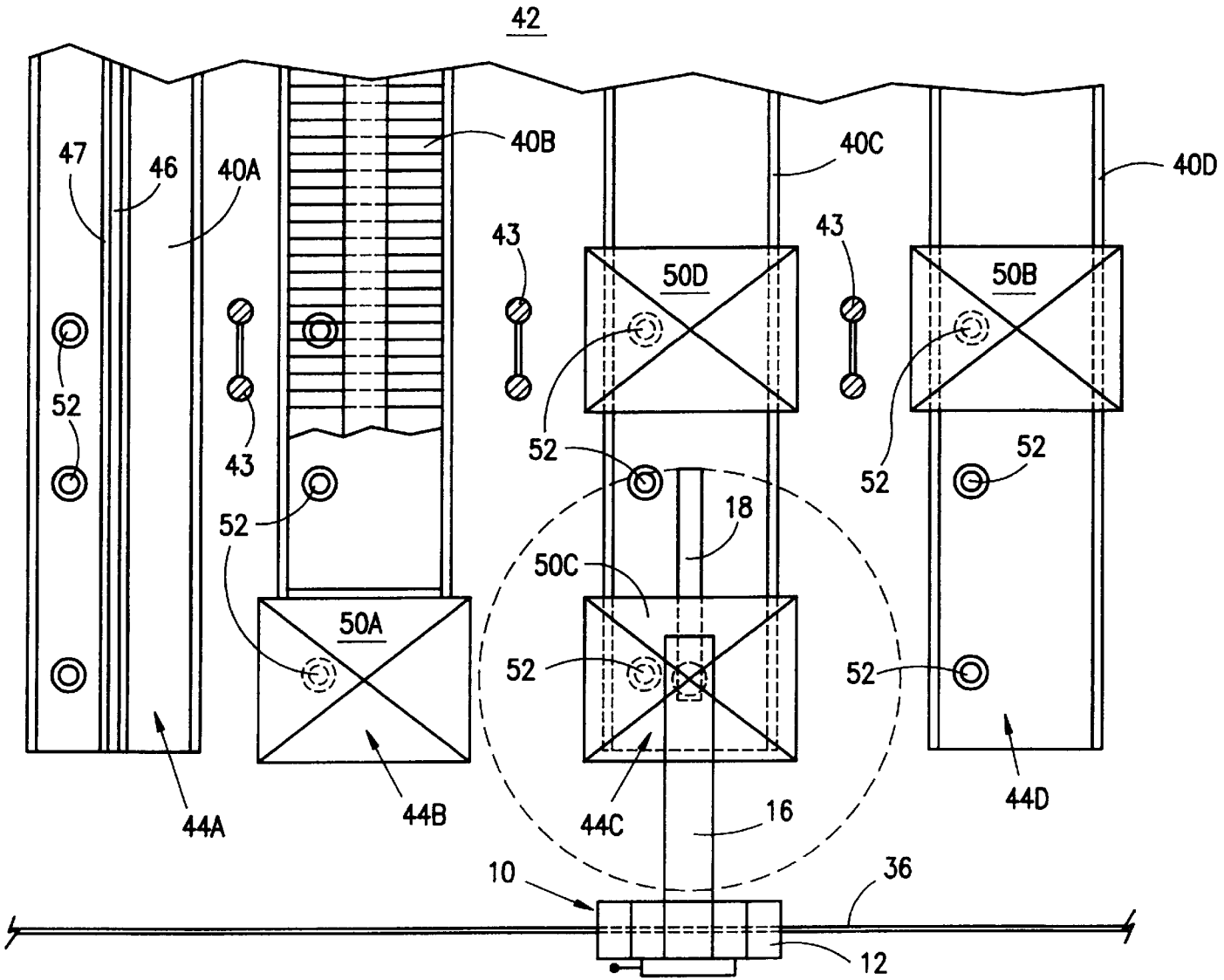
FIG. 2 is a simplified and schematic top view of a plurality of loaded pallets on parallel conveyors with the wrapping machine in the process of wrapping one loaded pallet which has been designated to be wrapped in its associated wrapping station.

The wrapping machine, per se, as described thus far, may comprise components of conventional wrapping machines such that further, detailed description is unnecessary to those skilled in the wrapping art. However, at this point it will be noted that machine 10 is not suspended from an overhead beam, nor does machine 10 have stationary support legs as required by conventional, stationary wrapping machines. Instead, it has been discovered that the most efficient and reliable operation is achieved when machine 10 rides along the floor 30 on wheels 32 mounted on axes 34 mounted in base portion 12. The number and relative placement of the wheels is not critical so long as they permit linear movement of base 12, and the entire machine 10, along a linear track 36. It has been found that the preferred form of track is a mechanical one such as U-shaped track 36 recessed into the floor 30 and including horizontal flanges 37 which are engaged by wheels 32 so as to maintain a highly level surface along the length of the track. A track following guide or fin 38 is mounted in base 12, and preferably between wheels 32, so as to maintain the movement of the wrapping machine along the linear length of track 36 as also shown in FIG. 2.

Because horizontal frame 16, swing arm 18 and downright support 24 create an unbalance of weight relative to support stand 14 and wheels 32 in the absence of stationary support legs, an upper guide mechanism 40 is provided. Such guide mechanism may take various forms such as, for example, a plurality of horizontal supports 41 which are connected to a plurality of vertical conveyor supports 43. In those installations where vertical conveyor supports, or other vertical supports are not present, lower portions 43A are not present, and upper portions 43B may be connected to conventional supports or any other available overhead structures. Horizontal supports 41 perform a dual function in that they support a horizontally extending bus bar 45 and a horizontally extending guide bar 48. Horizontal bus bar 45 is engaged by electrical brushes 49 carried by a support arm 52 connected to a horizontal frame member 16A which is connected to frame 16 by connector 16B. In this manner, electrical power is continuously supplied to machine 10 as it travels horizontally along track 36. In addition, two or more guide wheels 54A and 54B are carried by frame member 16A such that they engage the top and side surfaces of guide bar 48 and thereby stabilize the upper portion of machine 10 as it travels along the floor.

It will be understood that base 12 of the wrapping machine contains a reversible electric motor, a suitable gear drive connected to wheels 32 and an encoder connected to the drive shaft which monitors the position of the machine along track 36. Thus, wrapping machine 10 may be positioned to wrap such palletized loads as are prioritized by the automatic computer control system described hereafter. For this purpose, machine 10 includes remote actuated controls in housing 13, including a remote computer controller 14. Such remote controls may also include a receiver 15, which may be an antenna if radio controlled, or other sensor for receiving other remote signals as previously described. It will be understood that the above-described motor, gear drive and encoder, as well as the remote control receiver, are all commercially available components, per se, such that further detailed description is not necessary for one skilled in the art to fully understand.

In order to further insure the accurate positioning of the wrapping machine along track 36, base portion 12 preferably carries a photo cell 56 which co-acts with reflectors 58 mounted at the end of each conveyor so that the reflected signal confirms that the machine is directly in front of the selected conveyor, as will be more fully described hereafter.

FIG. 2 schematically illustrates a simplified wrapping system of the present invention which includes at least one wrapping machine 10, and a plurality of parallel conveyor lines such as, for example, 40A, 40B, 40C and 40D. Of course, it will be understood that one machine 10 may service many more than four conveyor lines. Conveyor lines 40A–40D extend from a loading area 42 toward respective wrapping stations 44A–44D. The conveyors, per se, are conventional conveyors and may include rollers or chains 46 riding over wear strips 47 as shown on line 40A and as is well known per se. The conveyor chains move the loaded pallets from loading area 42 to the respective wrapping stations 44A–44D.

As illustrated in FIG. 2, for example, four loaded pallets 50A–50D are located at a given point in time along conveyors 40A–40D. In this example, conveyor 40A is shown as having no loaded pallets at this time. Conveyor 40B is shown as having one loaded pallet 50A, which is in its respective wrapping station 44B, while conveyor 40D has one loaded pallet 50B approaching wrapping station 44D, and conveyor 40C is shown as having two loaded pallets; i.e., a first loaded pallet 50C positioned in wrapping station 44C, and a second loaded pallet 50D approaching wrapping station 44C.

Still referring to FIG. 2, it will be noted that a plurality of position sensors 52 are mounted on the conveyors along their lengths. Sensors 52 may comprise proximity switches, mechanically operated micro-switches, photo cells or any type of sensor which is capable of sensing the presence/absence of a loaded pallet at its position. As further illustrated in FIG. 3, each of sensors 52 is connected by wires 56 through a DH-485 Network 58 to master control computer (MCC) 60. Therefore, it will be understood that the positions of all loaded pallets along each conveyor is sensed and known, and is continuously transmitted from sensors 52 to MCC 60 which will now be further described as follows.

Figure 3:
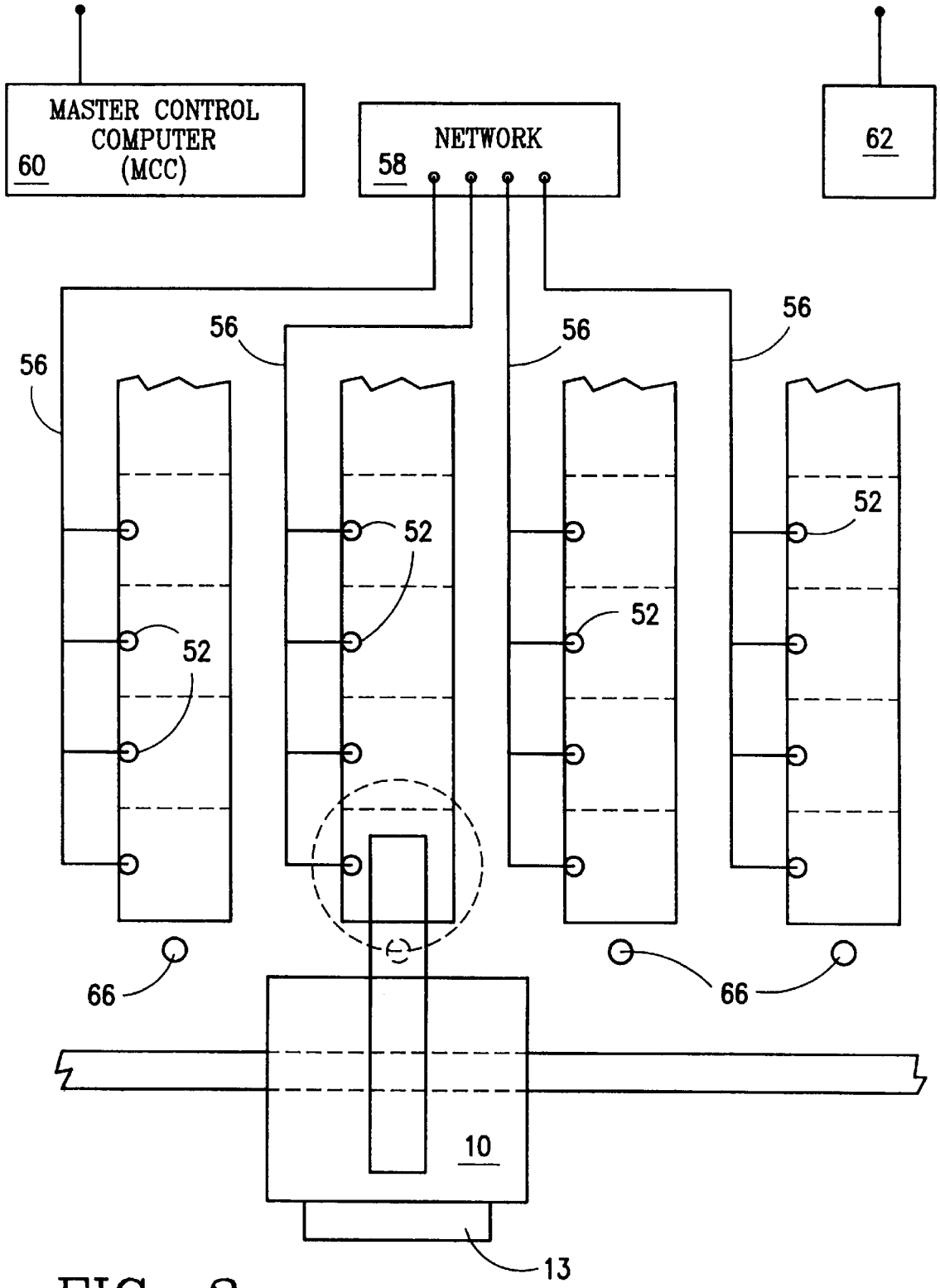
FIG. 3 is a schematic electrical diagram illustrating the essential components of the computerized control system.

Referring to FIG. 3, MCC 60 receives signals from each of position sensors 52 such that the presence or absence of loaded pallets at the respective wrapping areas, and at least two positions upstream thereof, is continuously fed to and known by MCC 60. Based upon this continuous input of the positions of the loaded pallets, the MCC sends signals to the controls 13 of the mobile wrapping machine which directs the machine to the next wrapping area based upon the relative activity of each conveyor line. For example, as illustrated in FIG. 2, machine 10 has been directed to conveyor 40C to wrap pallet 50C because machine 10 has received the following signals: (1) a first signal that pallet 50C is in its wrapping area, and (2) that a second pallet 50D is approaching the same wrapping area. The combination of these two signals takes precedence over the signals from conveyors 40A and 40D which indicate that no loaded pallet is in their respective wrapping areas 44A or 44D. In addition, the two signals from conveyor 40C take precedence over the single signal from conveyor area 44B regarding loaded pallet 50A because no other loaded pallet is detected as approaching this wrapping area. Accordingly, it will be understood that the system of the present invention continuously prioritizes the commands to the mobile wrapping machine so that the machine is directed to wrap the loaded pallets in the order of the activity level on each conveyor; i.e., the presence of loaded pallets in their respective wrapping areas as well as the number of loaded pallets on each conveyor which are immediately upstream of and approaching the respective wrapping area.

In addition to sensing the positions of the loaded pallets, and the position of the mobile wrapping machine, the present invention detects the height of each loaded pallet to be wrapped by one or more photo cells 64 as shown in FIG. 1. If the height of the load on the pallet is greater than a pre-programmed amount, then remote computer controller 14 located in housing 13 transmits a signal to the wrapping controls in housing 13 to cause the wrapping machine to double, triple or quadruple wrap the mid portion of the load in order to substantially increase the vertical stability of the load.

The preferred embodiment of the invention also provides an indicator light 66 adjacent each loading area, and the indicator lights an also controlled by the MCC. MCC 60 is programmed to turn on a light, in steady illumination, at the next prioritized wrapping area where a load is to be wrapped. This lets the fork truck operators know where the car is headed next. In addition, when the load has been wrapped, as signaled by controls 13 transmitting to the MCC, then the light is made to flash on and off. This flashing light alerts the fork truck operator that this wrapped load has priority to be removed as another loaded pallet is approaching the same wrapping area.

With regard to the details of the controls, all individual components are individually commercially available and will be apparent to those skilled in the computer control and radio transmitting art. For example, the MCC may be a pentium PC running a Data Acquisition package that is configured for monitoring the incoming signals and transmitting directional signals to the controls on the mobile wrapping machine. For transmitting, the MCC may utilize a Master Spread Spectrum RF transmitter to send radio signals to a Slave Spread Spectrum RF receiver, or other known radio transmitter and receiver. The mobile wrapping machine controls 13 may comprise an Allen-Bradley SLC 5/03 PLC to control the movement and wrapping functions of the wrapping machine. Typically, this PLC system includes an RF modem card to communicate with the MCC, an encoder card for the previously mentioned encoder, and such additional I/O cards as are necessary to control the drive motor, an air compressor in base 12 for generating on-board pneumatic power, warning horns and other safety and diagnostic systems.

From the foregoing description it will be apparent that the present invention solves all of the above-indicated problems, and provides an overall wrapping system which is fully automatic and requires no operator. However, if desired, a manually operated transmitter 62 may be provided for transmitting overriding signals so that an operator may intervene if necessary.

Of course, it is to be understood that the foregoing description of one preferred embodiment is intended to be purely illustrative of the principles of the invention, and not limiting of the invention, and that the true legal scope of the invention is not intended to be limited other than as expressly set-forth in the following claims interpreted under the doctrine of equivalents.

What is claimed is:

1. A wrapping system comprising:

(a) a plurality of parallel extending conveyors for moving loaded pallets from a loading area to a respective wrapping area of each conveyor;

(b) a mobile wrapping machine including wheels for running along a floor, a motor for driving said wheels, and controls for receiving remote signals;

(c) guide means for maintaining said machine in a linear path, said path being perpendicular to the extent of said conveyors and passing adjacent each of said loading areas;

(d) position sensor means for detecting the presence of a loaded pallet in a loading area and transmitting a signal thereof; and (e) computer control means for receiving signals from said position sensor means and for transmitting signals to said controls on said mobile wrapping machine, said computer control means including program means for directing said wrapping machine to wrap loaded pallets on a prioritized basis.

2. The wrapping system of claim 1 wherein said computer control means include means for transmitting radio signals, and said controls on said wrapping machine include a receiver for receiving said radio signals.

3. The wrapping system of claim 1 wherein said position sensor means sense the presence of a loaded pallet in any of said wrapping areas, and said sensor means also sense the presence of at least one loaded pallet approaching any wrapping area.

4. The wrapping machine of claim 3 including a network through which the signals from said position sensor means are fed to said computer control means.

5. The wrapping system of claim 1 including encoder means driven by said motor for continuously determining the linear position of said mobile wrapping machine.

6. The wrapping system of claim 5 including computer program means in said computer control means for directing said mobile wrapping machine to a next loading area which is not less than two conveyor lines away from the last loaded pallet which has been wrapped.

7. The wrapping machine of claim 1 wherein said guide means comprise a linear U-shaped track in said floor, and guide means carried by said mobile wrapping machine extending into said track.

8. The wrapping machine of claim 1 further including a horizontally extending guide bar mounted above said mobile wrapping machine and extending parallel to said linear path, and engagement means carried by said mobile wrapping machine for engaging said guide bar for stabilizing said machine.

9. The wrapping system of claim 8 further including horizontally extending bus bar means, and electrical contact means carried by said mobile wrapping machine, for continuously providing electrical power to said machine as said mobile machine moves along said path.

10. The wrapping machine of claim 1 further including compressor means carried by said mobile wrapping machine for providing pneumatic power to operate said machine to wrap said loaded pallets.

* * * * *